United States Patent [19]

Wassenhoven

[11] Patent Number: 4,744,209

[45] Date of Patent: May 17, 1988

[54] DEVICE FOR REMOVING RESIDUAL FIBER PARTICLES ON THE PERFORATED FRICTION SURFACES OF AN OE-FRICTION SPINNING MACHINE

[75] Inventor: Heinz-Georg Wassenhoven, Monchen-Gladbach, Fed. Rep. of Germany

[73] Assignee: W. Schlafhorst & Co., Monchen-Gladbach, Fed. Rep. of Germany

[21] Appl. No.: 820,191

[22] Filed: Jan. 17, 1986

[30] Foreign Application Priority Data

Jan. 23, 1985 [DE] Fed. Rep. of Germany ..... 3502118

[51] Int. Cl.[4] ..... D01H 7/885; D01H 1/12

[52] U.S. Cl. ..... 57/301; 57/263; 57/304; 57/401

[58] Field of Search ..... 57/261, 263, 301, 302, 57/304, 305, 401

[56] References Cited

U.S. PATENT DOCUMENTS

| | | | |
|---|---|---|---|
| 4,367,623 | 1/1983 | Parker et al. | 57/263 |
| 4,514,972 | 5/1985 | Stahlecker | 57/301 |
| 4,570,430 | 2/1986 | Stahlecker | 57/401 X |
| 4,570,434 | 2/1986 | Stahlecker | 57/401 |
| 4,612,762 | 9/1986 | Stahlecker | 57/301 |
| 4,617,792 | 10/1986 | Stahlecker | 57/401 |

*Primary Examiner*—John Petrakes

*Attorney, Agent, or Firm*—Herbert L. Lerner; Laurence A. Greenberg

[57] ABSTRACT

A device for removing residual fibers from perforated friction surfaces of an OE-friction spinning machine includes a suction device including a controllable cut-off element connected to a suction source, a suction tube section connected between the cut-off element and the friction surfaces, and a controllable compressed air connection disposed in the suction tube section.

18 Claims, 2 Drawing Sheets

Figure 1:
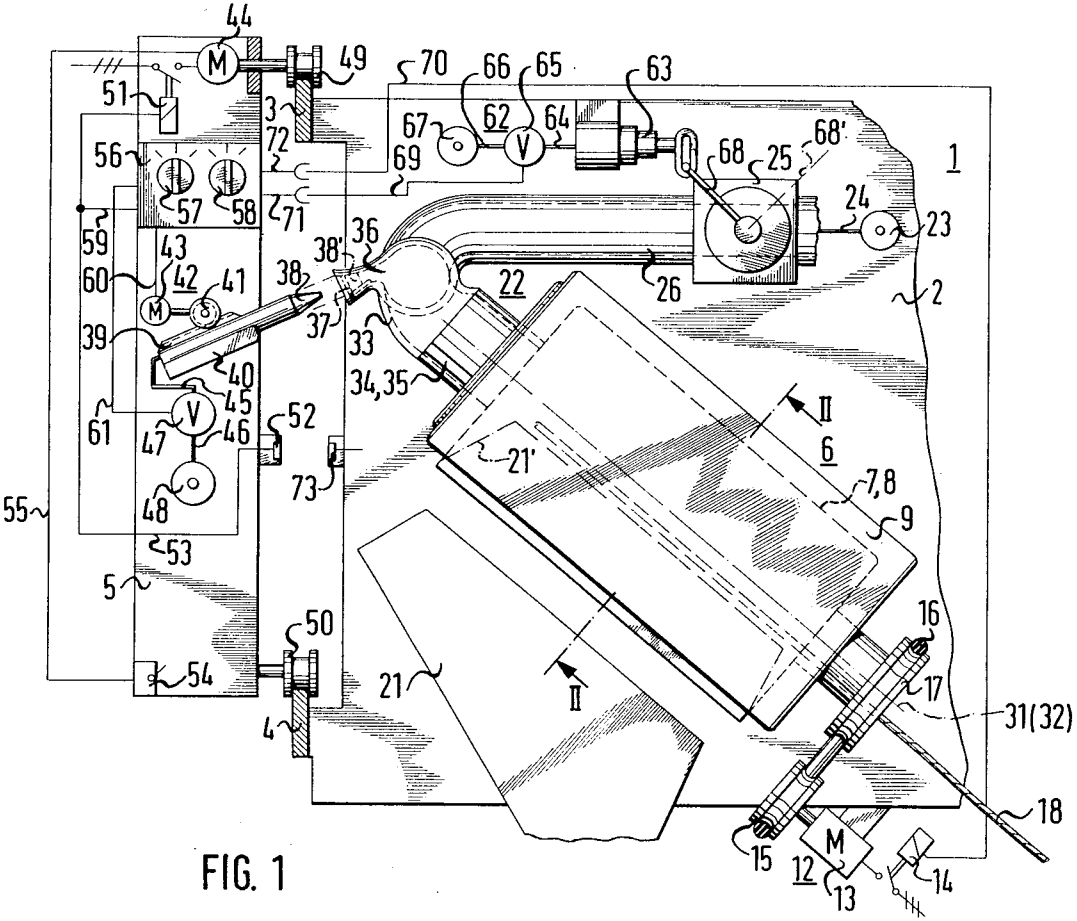

DEVICE FOR REMOVING RESIDUAL FIBER PARTICLES ON THE PERFORATED FRICTION SURFACES OF AN OE-FRICTION SPINNING MACHINE

The invention relates to a device for removing residual fiber particles on the perforated friction surfaces of an OE-friction spinning machine, including suction devices which work in conjunction with the friction surfaces.

If the thread breaks at a spinning station of an OE-friction spinning machine, the supply of fibers through the fiber feeding channel moves continuously toward the thread forming zone of the friction surfaces.

Since the suction device which operates together with the friction surfaces or with a single friction area, cannot stop its function instantaneously, fibers are sucked into the perforations of the friction surfaces and adhere there.

In order to start a new spinning operation, these residual fiber particles have to be cleaned off and removed from the friction surfaces. This task is not easily accomplished It is accordingly an object of the invention to provide a device for removing residual fiber particles on the perforated friction surfaces of an OE-friction spinning machine, which overcomes there hereinafore-mentioned disadvantages of the heretofore-known devices of this general type, and to create the conditions for quick and reliable removal of these residual fiber particles from the perforated friction surfaces in a simple way.

With the foregoing and other objects in view there is provided, in accordance with the invention, a device for removing residual fibers or fiber particles from perforated friction surfaces of an OE-friction spinning machine, comprising a suction device working in conjunction with the friction surfaces including a controllable cut-off element connected to a suction source, a suction tube section connected between the cut-off element and the friction surfaces, and a controllable compressed air connection disposed in the suction tube section. In order to clean the friction surfaces, compressed air surges are introduced into the suction tube section which is cut-off, so that compressed air flows through the perforations to the surroundings in the opposite direction to the previous suction direction and carries fibers, fiber remnants, and dirt along with it.

In accordance with another feature of the invention, there is provided a controllable compressed air nozzle and means for connecting the controllable compressed air nozzle to the controllable compressed air connection. It is not necessary to provide a fixed connection for the compressed air.

In accordance with a further feature of the invention, there are provided rails disposed on the spinning machine, and a traveling device carrying the controllable compressed air nozzle along the rails. It is advantageous if the compressed air nozzle can be moved into position by the traveling device, which can move on the rails or on a track. This device can be incorporated in a cleaning device, a starting device for the spinning operation, or any other servicing unit For example, the device can be kept on its course by rails or by induction.

In accordance with an added feature of the invention, there is provided a control device disposed on the spinning machine or on the traveling device and connected to the controllable compressed air nozzle for setting timing and duration of injection of compressed air into the controllable compressed air connection. For example, the compressed air is blown in after a thread break has occurred and after the cut-off element has been closed, but before the spinning operation is restarted again. The duration of the compressed air injection is essentially determined by the expected degree of contamination. The degree of contamination is also the determining factor as to whether one compressed air surge is sufficient or several successive compressed air surges have to be applied.

In accordance with an additional feature of the invention, the connecting means are in the form of a device for delivering the controllable compressed air nozzle to the controllable compressed air connection, and including an operative connection connected between the control device and the delivering device.

In accordance with again another feature of the invention, there is provided a device for controlling the cut-off element, and an operative connection connected between the control device and the device for controlling the cut-off element.

In accordance with again a further feature of the invention, there is provided a device for regulating compressed air fed to the controllable compressed air nozzle, and an operative connection connected between the control device and the regulating device In accordance with again an added feature of the invention, there is provided a drive for the friction surfaces, and an operative connection connected between the control device and the drive.

As soon as the traveling device has become positioned at the disturbed spinning station, the cut-off element of the suction device can be closed with the aid of the control device, if this has not been done already by some other means. Thereafter, the controllable compressed air nozzle of the compressed air connection of the suction tube section to which the compressed air is to be applied, can be moved into position The regulating device for the compressed air can then be activated, so that the drive for the friction surfaces can be simultaneously started In many cases it is advantageous to move the friction surfaces during the cleaning operation, such as by rotating the friction drums slowly, so that the whole perforated area can be cleaned uniformly.

In accordance with again an additional feature of the invention, there are provided means for newly establishing the operative connection from the control device to the device for controlling the cut-off element, at a respective spinning station of the spinning machine In accordance with yet another feature of the invention, there are provided means for newly establishing the operative connection from the control device to the drive at a respective spinning station of the spinning machine For instance, the operative or functional connections may be established by electrical plug-in contacts, or slide or slip contacts.

If the friction surfaces are to be rotated at a slower speed during the cleaning process than during the spinning process, their drives can be set to a slow speed.

In accordance with a concomitant feature of the invention, the controllable compressed air connection includes a spring-closing lid being opened by the controllable compressed air nozzle. Such a lid can be directly mechanically opened by the insertion of the compressed air nozzle. Other features which are considered as characteristic for the invention are set forth in the appended claims.

Although the invention is illustrated and described herein as embodied in a device for removing residual fiber particles on the perforated friction surfaces of an OE-friction spinning machine, it is nevertheless not intended to be limited to the details shown, since various modifications and structural changes may be made therein without departing from the spirit of the invention and within the scope and range of equivalents of the claims.

Figure 2:
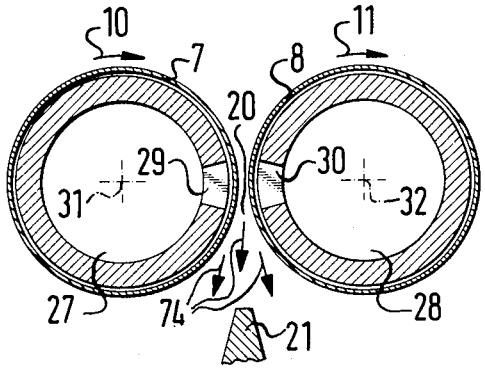

The construction and method of operation of the invention, however, together with additional objects and advantages thereof will be best understood from the following description of specific embodiments when read in connection with the accompanying drawings, in which:

FIG. 1 is a fragmentary, diagrammatic, elevational view of the device according to the invention; and FIG. 2 is a cross-sectional view taken along the line II—II in FIG. 1, in the direction of the arrows.

Referring now to the figures of the drawing in detail, there is seen an OE (open end) friction spinning machine which is designated as a whole by reference numeral 1 and which includes a number of individual spinning stations 2. Rails 3, 4 are provided in front of these spinning stations 2. A device 5 can move along these rails 3 and 4 and can travel from spinning station to spinning station.

Each spinning station 2 is provided with a friction spinning module 6, having perforated friction surfaces or wall 7, 8 having inner and outer surface, which are constructed in the form of perforated drums and which are rotatably supported in a housing 9. According to FIG. 2, the drums 7, 8 rotate in the direction of the arrows 10, 11. A drive 12 for the friction surfaces is formed of an electric motor 13, a control relay 14, a drive pulley 15, pulling means 16 and two pulleys or rollers 17 which are connected to the drums 7, 8. The pulling means 16 are wrapped around the pulley 17.

A twisted thread 18 is formed in one of two spinning wedges 20 formed by the friction surfaces 7, 8, as shown in FIG. 2. A fiber conducting channel 21 can be positioned or inserted in the spinning wedge 20. This positioning is accomplished by moving the channel 21 from the position 21 shown in FIG. 1 to the position 21' shown in phantom in FIG. 1, through the use of a pivoting motion around a pivot point which is not shown in the drawing. During the spinning operation the spinning fibers move through the fiber conducting channel 21 into the spinning wedge 20. The spinning fibers come from a fiber loosening device, which is also not illustrated. The finished thread 18 is pulled out continuously by non-illustrated means and is wound on a bobbin.

A suction device designated overall with reference numeral 22, operates in conjunction with the two perforated drums 7 and 8. The suction device 22 is formed of a suction channel 24 connected to a suction source 23, a controllable cut-off element 25, a suction tube section 26 located between the cut-off element 25 and the friction surfaces 7, 8 and two suction channels 27 and 28. The suction channels 27, 28 are disposed in the interior of the drums 7, 8 and have suction openings 29, 30 which are directed toward the spinning wedge 20. While the two drums 7, 8 according to FIG. 2 can rotate about the axes of rotation 31, 32, respectively, the suction channels 27 and 28 with their suction openings 29 and 30, stand still.

According to FIG. 1, the suction tube 26 ends in a Y-fitting or tube 33, which is connected to the suction channels 27 and 28 shown in FIG. 2 by two push-on connectors 34 and 35.

A controllable compressed air connection 36 is provided at the point where the suction tube section 26 meets the Y-fitting 33. The connection 36 is formed of a small funnel which is normally closed by a spring-loaded lid 37. However, if a compressed air nozzle 38 is moved into the position 38' and thereby enters the funnel 36, the lid 37 opens toward the inside of the funnel.

The compressed air nozzle 38 has a toothed rack 39 and rests on a support 40. The support 40 is part of the traveling device 5, which can move on the rails from station to station. A gear 41 which engages the rack 39, is part of a device 42 for delivering or moving the compressed air nozzle 38. The device 42 is provided with an electric motor 43 which is connected to the gear 41. The compressed air nozzle 38 is connected to a controllable compressed air regulating or dosing device 47 in the form of a controllable valve, by a movable line 45. The compressed air regulating device 47 is connected to a compressed air source 48 by a line 46.

The device 5 can travel on the rails 3 and 4 by means of rollers 49 and 50. The roller 49 serves as a drive roller and is connected to an electric motor 44 for this purpose. The electric motor 44 is supplied with electric energy through a control relay 51. A position sensor 52 is connected to the control relay 51 through a control line 53. The electric motor 44 can be switched from clockwise to counter clockwise rotation by a switch 54, and for this purpose it is connected to the switch 54 by an operational or functional connection 55.

According to FIG. 1, the device 5 has a programmed control 56, which includes a selector switch 57 for presetting the blowing time and a selector switch 58 for pre-selecting the number of compressed air pressure surges.

The control device 56 has to perform different functions. One of these functions is to control the timing of blowing-in the compressed air. For this purpose, the control device works in conjunction with the position sensor 52 and it is connected with the position sensor 52 through a control line 59 which branches off from the control line 53.

The control device 56 is connected to the device 42 for delivering the compressed air nozzle by an operational connection 60, and the control device is connected to the compressed air regulating valve 47 by an operational connection 61

Furthermore, the control device 56 serves to operate the cut-off element 25. This cut-off element is constructed as a rotary slide valve with control means 62 The control means 62 are formed of a pneumatic cylinder 63, which is connected to a controllable valve 65 by a line 64. The controllable valve 65 is connected to a compressed air source 67 by a line 66. A control rod 68 connects the cut-off element 25 with the cylinder 63, which can telescope foward. The cut-off element 25 is shown in the open position. The control device 56 can be connected to the cut-off element 25 by an operational connection 69 and sliding contacts 71.

An additional operational connection 70 exists between the drive 12 for the friction surfaces and an additional sliding contact 72 of the control device 56.

The device 5 travels back and forth in front of the OE-friction spinning machine 1, searching for a spinning station where it could operate. For example, if the device 5 is required at the spinning station 2, the spinning station 2 activates a transmitter 73, which, for example, can emit a light beam, to which the position sensor 52 responds. The position sensor 52 cuts out after the relay 51 has responded so that the electric motor 44 is instantly stopped, because the stator windings of the motor as well as the coil of a magnet which lifts a brake, have lost their current. At the same time, the position sensor 52 activates the control device 56 through the line 59, so that the control device 56 runs through its control program. The valve 65 is opened through the operational connection 69, so that the cylinder 63 is telescopically extended and the control rod 68 moves to a position 68'. Due to this motion of the control rod 68, the cut-off element 25 is closed and the tube portion 26 is disconnected from the source 23 of the suction air.

The compressed air nozzle delivering device 42 is then activated through the operational connection 60, which moves the compressed air nozzle 38 forward on the support 40, until it is in the position 38', in which it is connected to the compressed air connection 36 after having opened the lid 37. The operational connection 61 to the compressed air regulation device 47 is then operated, in order to generate one or more successive compressed air surges. The friction surface drive 12 is simultaneously operated through the operational connection 70 by switching the relay 14 which sets the electric motor to a slow speed.

While the drums 7 and 8 rotate slowly, compressed air is emitted from the suction openings 29 and 30 in a direction opposite to the direction of the suction previously existing, so that the compressed air escapes through the perforations into the surroundings and flows away in the direction of the arrows 74, according to FIG. 2. The escaping compressed air takes along dirt and remaining small fiber particles.

After the above-described cleaning operations, the control device 56 causes the retraction of the compressed air nozzle 38 to the starting position, turns off the valve 65, turns off the relay 14 and turns on the switch 51. The device 5 can then travel to another station, and leave the following operational steps which lead to a start of the spinning operation to another device The invention is not limited to the illustrated and described embodiment which was used as an example.

For instance, in an alternate version both branches of the Y-shaped tube 33 could have a connection 36 for the compressed air. In this case the device 5 would have two separate compressed air nozzles.

As an alternative, each of the two suction channels 27 and 28 could be connected with a separate suction tube section 26. Each of these suction tube sections could be provided with its own cut-off element 25. In this case two compressed air connections 36 would also be required for each spinning station.

As a further alternative, the device 5 could be provided with means for starting the spinning operation.

I claim:

1. OE-friction spinning machine in combination with a residual fiber removal device, the OE-friction spinning machine comprising perforated friction walls having inner and outer surfaces from which the residual fibers are to be removed by the residual fiber removal device, a suction device including a suction source, a controllable cut-off element connected to said suction source, a suction tube section connected between said cut-off element and said inner surfaces of said friction walls; and the residual fiber removal device comprising a compressed air source, and a controllable compressed air connection connected to said compressed air source and disposed in said suction tube section.

2. Combination according to claim 1, wherein the residual fiber removal device includes a controllable compressed air nozzle and means for connecting said controllable compressed air nozzle to said controllable compressed air connection.

3. Combination according to claim 2, wherein the OE friction spinning machine includes rails disposed thereon, and wherein the residual fiber removal device includes a traveling device carrying said controllable compressed air nozzle along said rails.

4. Combination according to claim 3, wherein the residual fiber removal device includes a control device disposed on said traveling device and connected to said controllable compressed air nozzle for setting timing and duration of injection of compressed air into said controllable compressed air connection.

5. Combination according to claim 4, wherein said connecting means are in the form of a device for delivering said controllable compressed air nozzle to said controllable compressed air connection, and including an operative connection connected between said control device and said delivering device.

6. Combination according to claim 4, wherein the residual fiber removal device includes a device for controlling said cut-off element, and an operative connection connected between said control device and said device for controlling said cut-off element.

7. Combination according to claim 6, wherein the OE-friction spinning machine includes spinning stations, and said residual fiber removal device includes means for newly establishing said operaative connection from said control device to said device for controlling said cut-off element at a respective spinning station of the spinning machine.

8. Combination according to claim 4, wherein the residual fiber removal device includes a device for regulating compressed air fed to said controllable compressed air nozzle, and an operative connection connected between said control device and said regulating device.

9. Combination according to claim 4, wherein the OE-friction spinning machine includes a drive for said friction walls, and an operative connection connected between said control device and said drive.

10. Combination according to claim 9, wherein the OE-friction spinning machine includes spinning stations, and said residual fiber removal device includes means for newly establishing said operative connection from said control device to said drive at a respective spinning station of the spinning machine.

11. Combination according to claim 2, wherein the residual fiber removal device includes a control device disposed on the OE-friction spinning machine and connected to said controllable compressed air nozzle for setting timing and duration of injection of compressed air into said controllable compressed air connection.

12. Combination according to claim 11, wherein said connecting means are in the form of a device for delivering said controllable compressed air nozzle to said controllable compressed air connection, and including an operative connection connected between said control device and said delivering device.

13. Combination according to claim 11, wherein the residual fiber removal device includes a device for controlling said cut-off element, and an operative connection connected between said control device and said device for controlling said cut-off element.

14. Combination according to claim 13, wherein the OE-friction spinning machine includes spinning stations, and said residual fiber removal device includes means for newly establishing said operative connection from said control device to said device for controlling said cut-off element at a respective spinning station of the spinning machine.

15. Combination according to claim 11, wherein the residual fiber removal device includes a device for regulating compressed air fed to said controllable compressed air nozzle, and an operative connection connected between said control device and said regulating device.

16. Combination according to claim 11, wherein the OE-friction spinning machine includes a drive for said friction walls, and an operative connection connected between said control device and said drive.

17. Combination according to claim 16, wherein the OE-friction spinning machine includes spinning stations, and said residual fiber removal device includes means for newly establishing said operative connection from said control device to said drive at a respective spinning station of the spinning machine.

18. Combination according to claim 2, wherein said controllable compressed air connection includes a sping-closing lid being opened by said controllable compressed air nozzle.

* * * * *